United States Patent [19]

House

[11] 3,966,361

[45] June 29, 1976

[54] TRACTOR MOUNTABLE ADJUSTABLE HIGH VOLUME WATER PUMP

[76] Inventor: Bennie L. House, P. O. 577, Hickory Ridge, Ark. 72347

[22] Filed: May 19, 1975

[21] Appl. No.: 578,720

[52] U.S. Cl. ..... 417/231
[51] Int. Cl.[2] ..... F04B 17/06
[58] Field of Search ..... 417/231, 232

[56] References Cited

UNITED STATES PATENTS

| | | | |
|---|---|---|---|
| 2,462,588 | 2/1949 | Wondra | 417/231 |
| 2,698,583 | 1/1955 | House et al. | 417/231 |
| 3,170,646 | 2/1965 | Springer | 417/231 |
| 3,779,670 | 12/1973 | Crisafulli | 417/231 |

*Primary Examiner*—William L. Freeh
*Assistant Examiner*—G. P. LaPointe
*Attorney, Agent, or Firm*—Robert R. Keegan

[57] ABSTRACT

There is disclosed a pump and adjustable supporting structure arranged to be mounted to a tractor through the conventional three-point tractor hitch arrangement and which is adjustable for vertical positioning upward and downward with respect to the ground level and is also adjustable to render the centrifugal pump housing level (and the discharge pipe vertical) with respect to the pool of water to be pumped in addition to which the direction of discharge from the vertically disposed discharge pipe is fully adjustable through 360°. The support structure is also readily dismantled for replacement of parts, for storage, or for shipping, but is never-the-less quite rigid and rugged.

9 Claims, 3 Drawing Figures

TRACTOR MOUNTABLE ADJUSTABLE HIGH VOLUME WATER PUMP

The present invention relates to tractor mountable pumps usable for agricultural purposes such as irrigation, flood water removal, and other purposes. High volume, low lift centrifugal pumps arranged to be driven from the power take-off of an agricultural tractor are known. Such arrangement is shown, for example, in U.S. Pat. No. 2,698,583 for "Portable Relift Pump" in the name of Bennie L House and Arthur K. Shaw.

The apparatus described herein is an improvement over such previous devices, particularly in the structure for supporting the pump and rigidly and ruggedly connecting it to the tractor (which supplies both power to operate the centrifugal pump and a means of transporting the pump to its place of use). The support structure constituting the present invention is virtually universally adjustable to accommodate variations in the terrain where the pump is being used to that the pump housing and impeller may be located properly with respect to the surface of the water being pumped in all situations. The pump may also be tilted up to an inoperative position to facilitate its transportation to a new location. In addition, complete flexibility is afforded in the direction that the water is to be discharged.

In addition to the flexibility provided in transporting and positioning the apparatus for operation, the structure is arranged to be conveniently dismantled for part replacement, for storage, or for shipping. Notwithstanding the foregoing features providing flexibility and capability of dismantling, the assembled structure is quite rigid and exceedingly rugged and thus well adapted to the hard usage to which such apparatus is commonly exposed.

Accordingly, it is an object of the present invention to provide a tractor-mountable high-volume low-lift pump for irrigation or the like which is readily adjustable apart from the tractor hitch raising and lowering mechanism so as to permit optimum vertical placement of the pump impeller and housing in whatever terrain may be encountered.

It is another object of the invention to provide an adjustment mechanism for a tractor-mountable ground water pump which permits adjustment of the pump drive shaft and discharge pipe to a vertical pumping position or to a more nearly horizontal position to elevate the pump housing for transportation over rough terrain.

It is a further object of the invention to provide such an adjustable support structure wherein the structural integrity and ruggedness of the structure is in no way impaired by the adjustability features.

It is a still further object of the present invention to provide a tractor-mountable high-volume low-lift pump with support structure that is rigid and rugged, yet readily dismantled to facilitate replacement of parts, storage, or shipping.

Other objectives and advantages of the present invention will be apparent from consideration of the following description in conjunction with the appended drawings in which.

Figure 1:
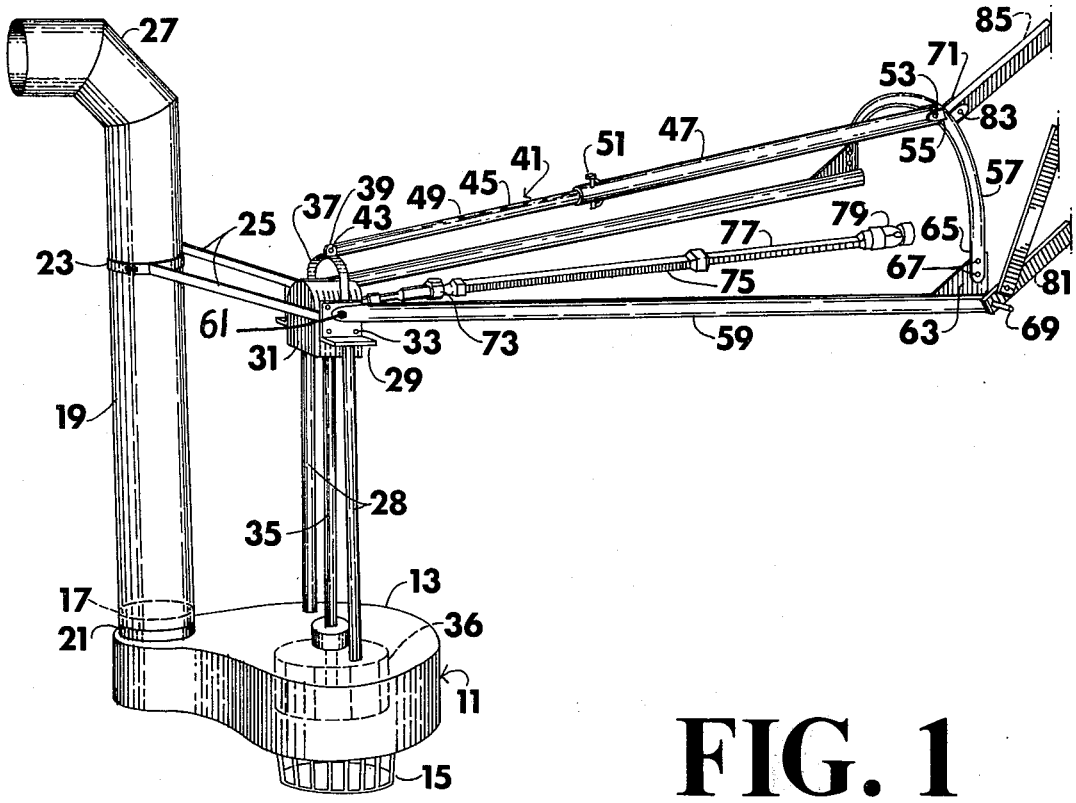
FIG. 1 shows an elevational view in perspective of the tractor-mountable pump and support structure according to the present invention.
Figure 2:
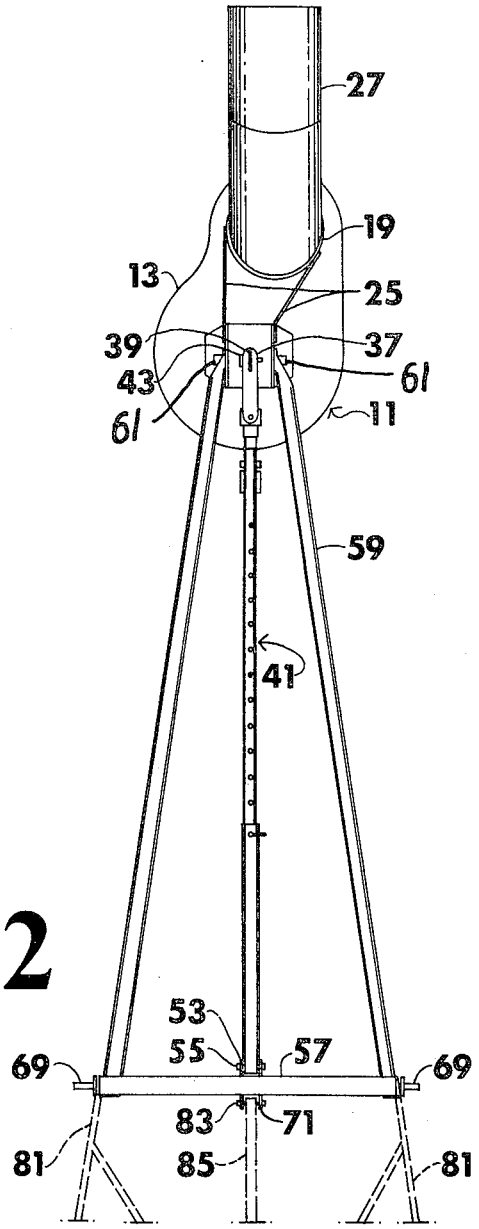
FIG. 2 is a top plan view of the apparatus of FIG. 1.

Referring to FIGS. 1 and 2, a centrifugal pump structure 11 is provided including an impeller housing or bowl 13 and an intake guard or basket 15. The pump bowl 13 is provided with an outlet pipe 17, indicated in dashed lines in FIG. 1. A discharge pipe 19 connects to the outlet 17 and is secured thereto by a discharge pipe clamp 21. Packing in the form of several turns of tape is preferably provided between the outlet 17 and the discharge pipe 19 to reduce leakage and also improve the frictional engagement between discharge pipe 19 and outlet 17.

The discharge pipe 19 is secured to bowl 13 by the clamp 21 of conventional form which may be tightened by means of a nut and bolt. Accordingly, the discharge pipe 19 may be turned in any position relative to bowl 13 and clamped in that position by means of clamp 21.

The upper portion of discharge pipe 19 is secured by means of a further ring clamp 23 and discharge braces 25. Ring clamp 23 is also capable of being loosened to permit the rotation of discharge pipe 19 relative to bowl 13. The extreme upper portion of discharge pipe is provided with an elbow portion 27 providing a horizontal outlet for the discharge pipe 19. As will be apparent from the previous description, the rotation of the discharge pipe 19 relative to the bowl 13 permits the water discharged from the pump to be ejected in any desired direction. A flexible large diameter hose may also be connected to the discharge end of the discharge pipe 19 if desired.

The pump bowl 13 is supported by vertical support rods 27 which may be permanently secured at their lower ends to bowl 13 as by welding and secured at their upper ends (also by welding) to flange members 29.

Flange members 29 are arranged to be bolted to an angle gear box 31 in a demountable manner as by machine bolts 33.

The gear box 31 is provided with a long integral shaft 35 extending to the pump bowl 13 wherein it is firmly connected to an impeller 36 (shown in dashed lines) for rotation of the impeller 36 which, of course, provides the centrifugal pumping action for the pump. The impeller 36, the bowl 13, and their operation is conventional and will not be described in detail. The shaft 35 is without joints or junctions between the gear box 31 and its lower end, which is splined, keyed, or otherwise connected to rotate impeller 36; it is thus superior to other less direct means of driving the impeller 36 and permits a power of 10 horsepower or more to be reliably transmitted to the lift pump from the tractor.

From the previous description, it will be seen that the pump bowl, pump discharge pipe, pump shaft, and the gear box are assembled into one unit. It will later be seen how this unit is pivotally adjustable with respect to the support structure and, hence, the tractor on which the pump is mounted.

Secured on the top of the angle brackets 29 is a yoke member 37, having a vertical lug 39 to provide for attachment of a top (adjustable) brace 41 by means of a bolt 43.

The top brace 41 includes a pair of tubes 45 and 47 with the former telescoping within the latter. The smaller tube 45 is provided with a number of holes 49 extending approximately 2 feet along its length and the larger tube 47 is provided with a matching hole and a retaining pin 51 so that the full length of the top brace 41 is adjustable in steps of approximately 1 inch. The end of the top brace 41 nearest the tractor is pivotally connected by means of a pin or bolt 53 to lugs 55 extending rearwardly from the top of a U-brace 57.

A pair of main arms 59 support the weight of the pump from the U-brace 57. The gear box and pump structure is pivotally supported at the ends of main arms 59 by a pair of pins 61 welded to angle brackets 29 and engaging holes in the outer ends of main arms 59.

Main arms 59 are provided with brackets 63 which may be rigidly welded to the ends of main arms 59. Each of the main arms 59 and the U-brace 57 are rigidly connected by bolts 67 connecting a flattened end 65 of the U-brace 57 to a flange 63 of a respective main arm 59. As seen from the previous description and the illustration of FIG. 1, the main arms 59 are rigidly connected with respect to the U-brace 57 while the gear box and pump structure are pivotally supported from the ends of the main arms 59. The adjustable length top brace 41 permits the pivotal position of the gear box and pump to be determined by adjusting and locking the top brace 41.

The pump support structure is connected to the conventional three-point tractor hitch by means of pins 69 extending outwardly at the end of main arms 59 and at the top by a pair of lugs 71 welded or otherwise securely fastened to the top of the U-brace 57.

Each pin 69 engages a hole in a powered link 81 of the tractor hitch (shown in dashed lines). Lugs 71 are similarly coupled by a pin 83 to a floating link 85 (shown in dashed lines) of the tractor hitch.

Virtually all tractors with the three-point hitch arrangement are standardized for the attachment of various implements for agricultural use and have provisions for raising and lowering whatever implement may be attached to the three-point hitch, usually with a hydraulic mechanism operated from the tractor operator's position.

Power is supplied to the pump through the shaft 35 and the gear box 31 as previously described. Furthermore, the gear box 31 is connected to the tractor power take-off through a first universal joint 73 and a telescoping shaft consisting of shaft sections 75 and 77. Sections 75 and 77 have a square cross section or are otherwise constructed to transmit rotational movement while at the same time permitting variations in length of the shaft. These length variations accommodate adjustments in the pivotal position of the gear box and pump structure or changes in position by virtue of raising or lowering the U-brace 57 under control of the tractor hydraulic system. The second universal joint 79 completes the connection of the pump drive train to the tractor power take-off.

Figure 3:
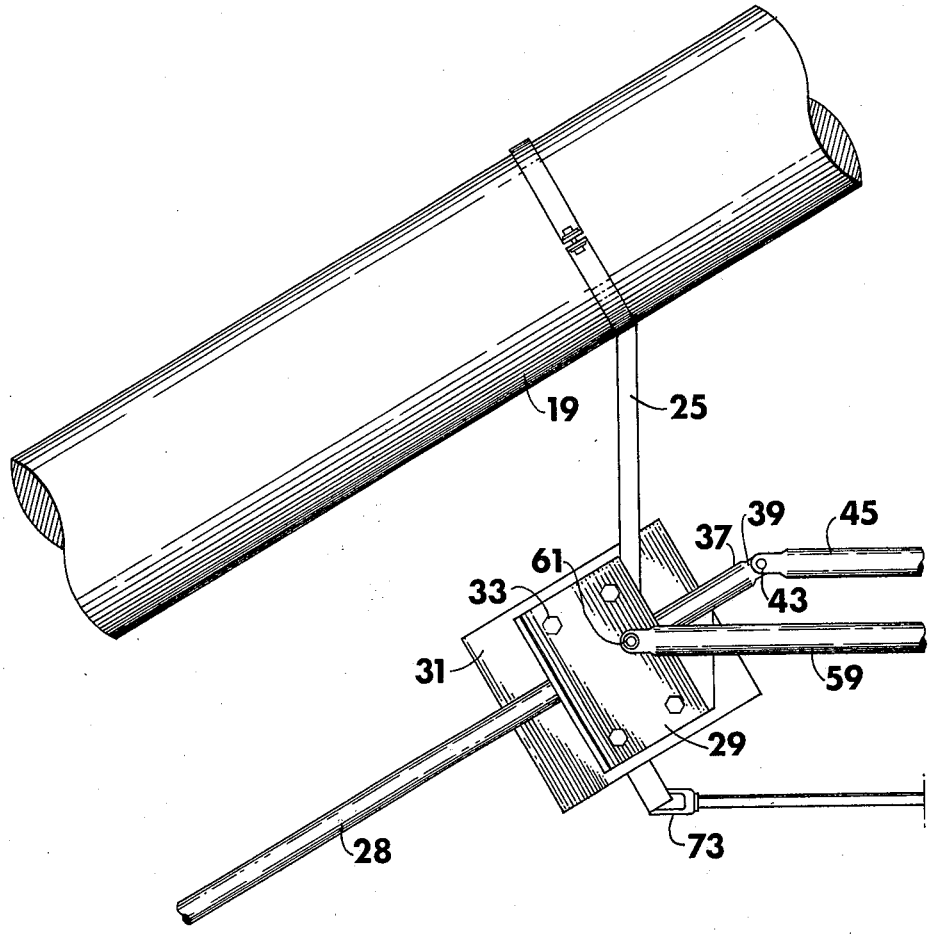
FIG. 3 is a fragmentary elevational view of the apparatus adjusted to a different position as for transporting to a new location of use.

The support structure illustrated in FIGS. 1–3 provides particularly convenient and flexible operation and transportation of the pump equipment. Generally, the pump would be adjusted for transportation to the location of use by raising the hydraulically operated tractor hitch mechanism to its upper limit and also tilting the pump unit about pivot points 61 to shorten the adjustable top brace 41 to or near to its shortest length. This raises the pump structure 11 well above ground level and facilitates moving the equipment over rough terrain. When the pump structure 11 is raised to its maximum elevation in this manner, the universal joint 73 will be placed at a sharp angle so that it would not be operative. This is of no consequence, however, since the pump would never be operated in such an extreme position.

Upon reaching the location at which the pump is to be used, the tractor is maneuvered to place the end of the support structure and the gear box 31 over the desired location for the centrifugal pump structure 11. The pump structure is then dropped to a vertical position by releasing the pin 51. The weight of the pump structure is distributed so that it will generally assume a vertical position with little or no adjustment necessary. The support structure is then preferably locked into position by inserting pin 51 through an appropriate opening 49 in rod 45.

It should be particularly noted that it is unnecessary for the tractor itself to be level and, in fact, the tractor could be on a quite steep embankment without creating problems with the proper orientation of the pump structure 11. The operation of the pump will be unaffected by the tilt of the support structure connected to the tractor so long as the universal joint 73 is within its relatively wide range of operative angles.

The up and down motion needed to place the pump structure 11 at the desired depth relative to the water level is provided by the hydraulic mechanism or other mechanism provided on the tractor for raising and lowering the three-point hitch. Of course, if adjustment of the three-point hitch mechanism on the tractor should cause the pump structure to be tilted away from the vertical, it may be readjusted to a vertical position by adjustment of the adjustable top brace 41.

After positioning the tractor and the pump structure, the pump may be placed in operation to discharge water from the top of the discharge pipe 19. Of course, if the direction in which the discharge pipe is pointed is undesirable, this may be corrected by loosening clamps 21 and 23 and rotating the elbow portion 27 to the desired direction.

When the pumping operation has been completed and it is desired to move the pumping equipment to a different location, the previously described steps are essentially reversed. In some cases, it may be desired to unlock the top brace 41 by removing the pin 51 and use the tractor motion to aid in tilting the pump structure 11 upward to the transporting position (illustrated in FIG. 3).

Notwithstanding the rugged and durable construction of the pump support structure, it is arranged to be conveniently dismantled for storage, for shipment, or if necessary for replacement of parts. Note, for example, that top brace 41, arms 59, and U-brace 57 may all be disconnected by removing bolts or cotter pins. Furthermore, flanges 29 may be disconnected from the gear box 31 by removing the connecting bolts, then by removing impeller 36. The entire pump structure may be disconnected from shaft 35 and the gear box 31. The outlet pipe is, of course, readily removed by loosening clamps 21 and 23.

In addition to the particular embodiments of the invention shown and suggested, variations and modifications thereof will be apparent to those skilled in the art; and the scope of the invention should be deemed to include such variations and modifications.

What is claimed is:

1. A portable water pump adapted to attach to the three-point hitch of a tractor and be powered by the tractor power take-off comprising:

an immersible centrifugal pump impeller and housing therefor, an outlet conduit extending upwardly from said housing, a vertical elongated support connected at its lower end to said housing, a rigid shaft connected to said impeller and extending upwardly from said housing, a right angle drive unit connected rigidly to the upper end of said support and in driving relation with the upper end of said shaft, a pair of horizontal arms, pivot means for connecting said support at one end of said horizontal arms with pivotal movement about a horizontal axis, said axis being above the center of gravity of the entire structure connected to said support including said pump impeller and housing, rigid shaft, and gear drive unit, a mounting frame rigidly connected to the other ends of said arms with said other ends in spaced apart relation, coupling means for attaching said mounting frame and horizontal arms to the three-point hitch mechanism of said tractor, a variable length shaft having a universal joint at one end connected to the input shaft of said gear drive unit and a universal joint at the other end adapted to be connected to the power take-off of said tractor, and means for adjusting and maintaining the pivotal position of said pump housing and support including, a brace connected with one end in fixed relation to said mounting frame and horizontal arms and the other end pivotally attached in fixed relation to said vertical elongated support at a point spaced from said horizontal axis about which said support pivots, and a means for adjusting and maintaining the length of said brace to position said pump housing and support.

2. Apparatus as claimed in claim 1 wherein said horizontal arms are demountably attached to said mounting frame and to said vertical elongated support.

3. Apparatus as claimed in claim 1 wherein said brace is of variable length telescoping construction and provided with holes and a locking pin for maintaining its length to position said pump housing.

4. A portable water pump adapted to attach to the three-point hitch of a tractor and be powered by the tractor power take-off comprising:

an immersible centrifugal pump impeller and housing therefor, an outlet pipe extending vertically from said housing and having a horizontal discharge opening, a vertical elongated support including a pair of vertical rods connected at their lower ends to said housing, braces connecting said support to said outlet pipe, a rigid shaft connected to said impeller and extending upwardly from said housing substantially parallel to said rods, a right angle gear drive unit connected rigidly to the upper end of said support and in driving relation with the upper end of said shaft, a pair of horizontal arms, pivot means for connecting the top portion of said support at one end of said horizontal arms with pivotal movement about a horizontal axis, said axis being above the center of gravity of the entire structure connected to said support including said pump impeller and housing, outlet pipe, rigid shaft, and gear drive unit, a mounting frame in the form of an inverted U connected to the other ends of said arms with said other ends connected in spaced apart relation on respective legs of said frame, coupling means for attaching said mounting frame at its top to the floating link and at its legs to the powered links of the three-point hitch mechanism of said tractor, a variable length telescoping drive shaft having a universal joint at one end connected to the input shaft of said gear drive unit and a universal joint at the other end adapted to be connected to the power take-off of said tractor, and means for adjusting and maintaining the pivotal position of said pump housing and support including, a variable length telescoping brace connected with one end in fixed pivotal relation at the top of said mounting frame and the other end pivotally attached to said support at a point above said horizontal axis about which said arms pivot, and a locking pin for maintaining the length of said telescoping brace to position said pump housing and support.

5. Apparatus as claimed in claim 4 wherein said outlet pipe is rotatably adjustable to direct said horizontal discharge opening in different directions.

6. Apparatus as claimed in claim 4 wherein said rods are welded at their lower ends to said housing and said support includes a pair of flanges to which the upper ends of said rods are welded.

7. A portable water pump adapted to attach to a tractor and be powered by the tractor take-off comprising:

an immersible centrifugal pump having an impeller and an outlet conduit, a support column connected at its lower end to said pump, a shaft connected to the impeller of said pump and extending upwardly therefrom, a right angle drive unit connected in driving relation with the upper end of said shaft, a cantilever support, pivot means for connecting said support column and one end of said cantilever support with pivotal movement having a horizontal axis located above the center of gravity of said pump, shaft, drive unit, and support column, coupling means for attaching the other end of said cantilever support to said tractor, drive means connected through said drive unit to said shaft adapted to be connected to the power take-off of said tractor, and means for adjusting and maintaining the pivotal position of said pump housing and support.

8. Apparatus as claimed in claim 7 further including an upstanding discharge pipe rotatably coupled to said outlet conduit and having a horizontal discharge opening at the upper end thereof.

9. Apparatus as claimed in claim 7 wherein said drive means includes a variable length shaft having a universal joint at one end connected to said right angle drive unit and a universal joint at the other end adapted to be connected to the power take-off of said tractor.

* * * * *